US007884694B2

(12) United States Patent
Hsueh et al.

(10) Patent No.: US 7,884,694 B2
(45) Date of Patent: Feb. 8, 2011

(54) TRANSFORMER

(75) Inventors: Ching-Fu Hsueh, Bade (TW); Wen-Hsien Chen, Guansi Township, Hsinchu County (TW); Wei-Shun Liao, Pingjhen (TW); Ho-Chun Lee, Bade (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 0 days.

(21) Appl. No.: 12/248,429

(22) Filed: Oct. 9, 2008

(65) Prior Publication Data

US 2009/0096564 A1 Apr. 16, 2009

(30) Foreign Application Priority Data

Oct. 11, 2007 (TW) ..... 96217003 U

(51) Int. Cl.
*H01F 27/30* (2006.01)

(52) U.S. Cl. ..... 336/198

(58) Field of Classification Search ..... 336/65, 336/83, 198, 200, 232
See application file for complete search history.

(56) References Cited

U.S. PATENT DOCUMENTS

| | | | | |
|---|---|---|---|---|
| 4,931,761 | A * | 6/1990 | Kijima | 336/160 |
| 2006/0132273 | A1 * | 6/2006 | Shinmen et al. | 336/200 |
| 2006/0145802 | A1 * | 7/2006 | Chung | 336/182 |
| 2006/0181384 | A1 * | 8/2006 | Hsueh et al. | 336/122 |

* cited by examiner

*Primary Examiner*—Tuyen Nguyen
(74) *Attorney, Agent, or Firm*—Thomas, Kayden, Horstemeyer & Risley

(57) ABSTRACT

A transformer is provided. The transformer includes at least a high voltage coil, at least a low voltage coil and a soft-magnetic colloid element. The soft-magnetic colloid element is disposed between the high voltage coil and the low voltage coil.

12 Claims, 8 Drawing Sheets

300

200

TRANSFORMER

This application claims the benefit of Taiwan application Serial No. 96217003, filed Oct. 11, 2007, the subject matter of which is incorporated herein by reference.

BACKGROUND OF THE INVENTION

1. Field of the Invention

The invention relates in general to a transformer, and more particularly to a miniaturized transformer.

2. Description of the Related Art

As the technology develops, the trends of all kinds of electronic devices have been directed toward miniaturization and light weight. Internal electronic devices also develop toward miniaturization. However, many problems occur in the process of miniaturizing electronic devices.

Take transformers as an example. It has been over a century since transformers were first manufactured by a Hungarian company called GANZ in 1885. Transformers are widely used for a long time and have evolved into many types of transformers. However, the principles are still unchanged. Transformers transfer electrical energy to/from magnetic energy. Two sets of coils are wound on a common iron core. The coil connected to a power terminal is called primary coil, and the coil connected to a load terminal is called secondary coil. Or, the coils can also be called as high voltage coil and low voltage coil based on the voltage magnitude. The primary coil can be the high voltage coil or the low voltage coil depending on the voltage magnitude.

When the primary coil is connected to an alternating current power source, the current passing through the coil generates a change in the magnetic flux. The secondary coil at the other end generates alternating current with the same frequency due to induced electromotive force (EMF).

However, the distance between the primary coil and the secondary coil (or called the high voltage coil and the low voltage coil) is enlarged to increase the leakage inductance of the transformer, which increases the size of the transformer as well. Therefore, the requirement of miniaturization cannot be met. When the diameter of the primary coil or the secondary coil (or called the high voltage coil and the low voltage coil) is reduced, the distance between the primary coil and the secondary coil is enlarged. However, the current limit is lowered, which endangers the safety of using transformers.

Therefore, it is still a critical difficulty to develop miniaturized transformers with high leakage inductance.

SUMMARY OF THE INVENTION

The invention is directed to a transformer which uses soft-magnetic colloid element so that the transformer has the properties including small size, high leakage inductance and high inductance.

According to the present invention, a transformer is provided. The transformer includes at least a high voltage coil, at least a low voltage coil and at least a soft-magnetic colloid element. The soft-magnetic colloid element is disposed between the high voltage coil and the low voltage coil.

The invention will become apparent from the following detailed description of the preferred but non-limiting embodiments. The following description is made with reference to the accompanying drawings.

DETAILED DESCRIPTION OF THE INVENTION

First Embodiment

Figure 1A:
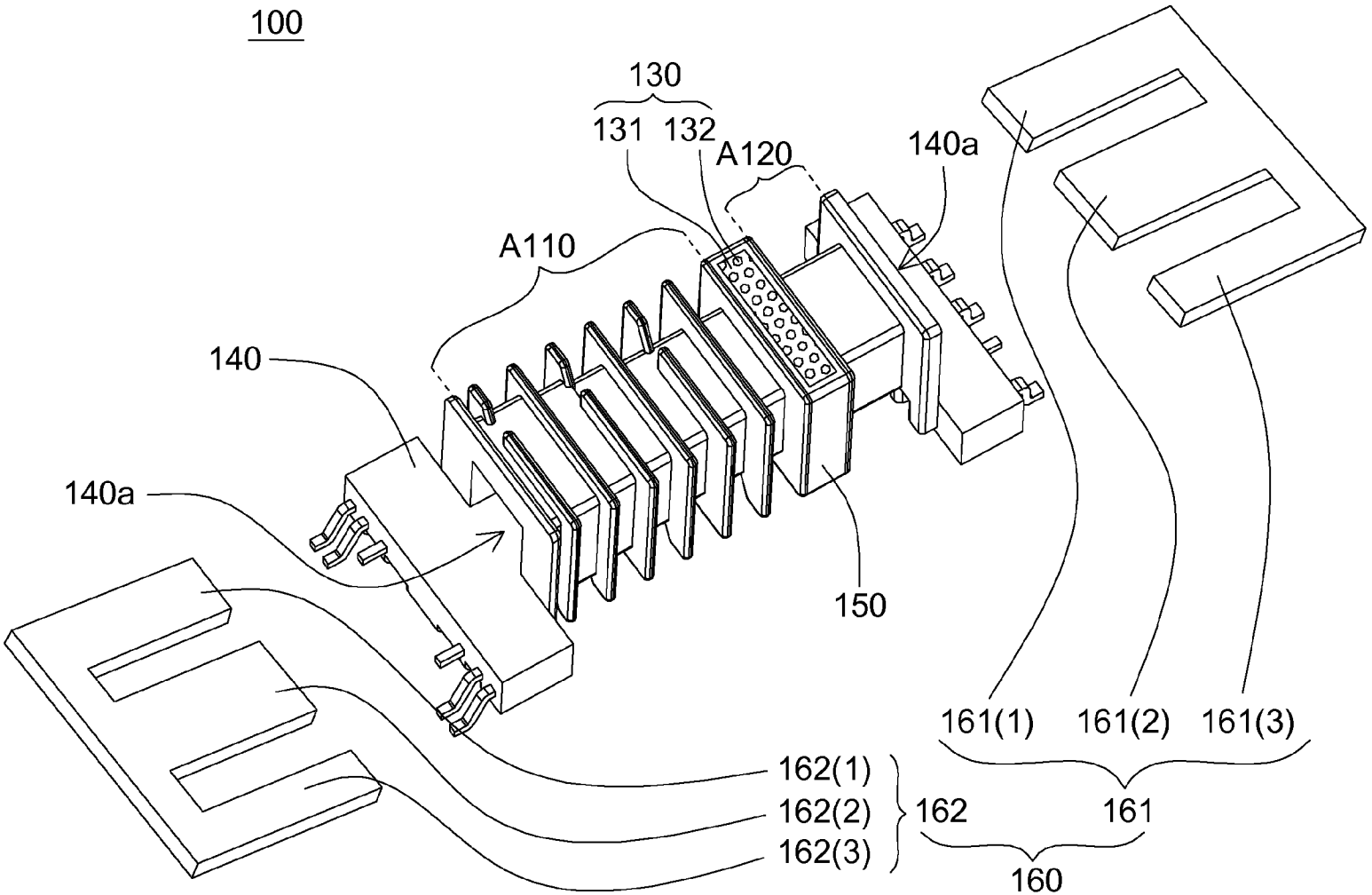
FIG. 1A illustrates a front three-dimensional view of a transformer according to a first embodiment of the present invention.
Figure 1B:
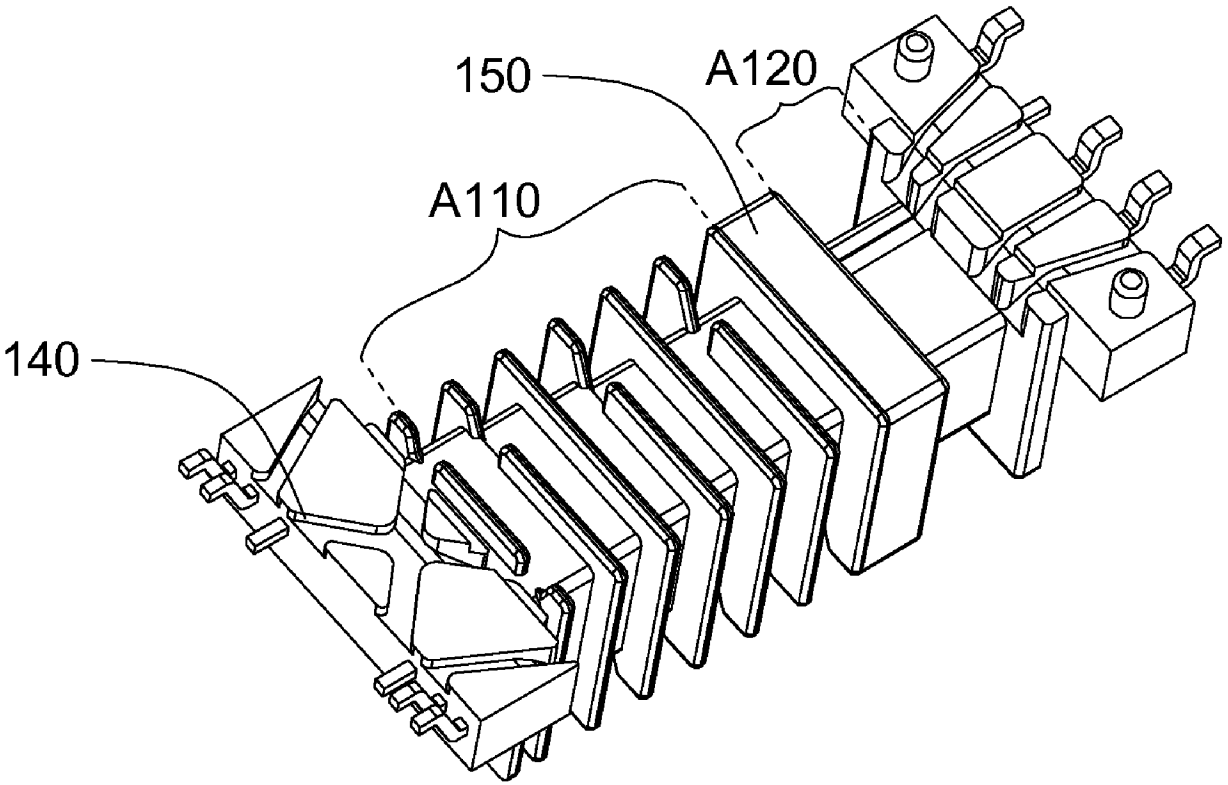
FIG. 1B illustrate a back three-dimensional view of a lead frame in FIG. 1A.
Figure 1C:
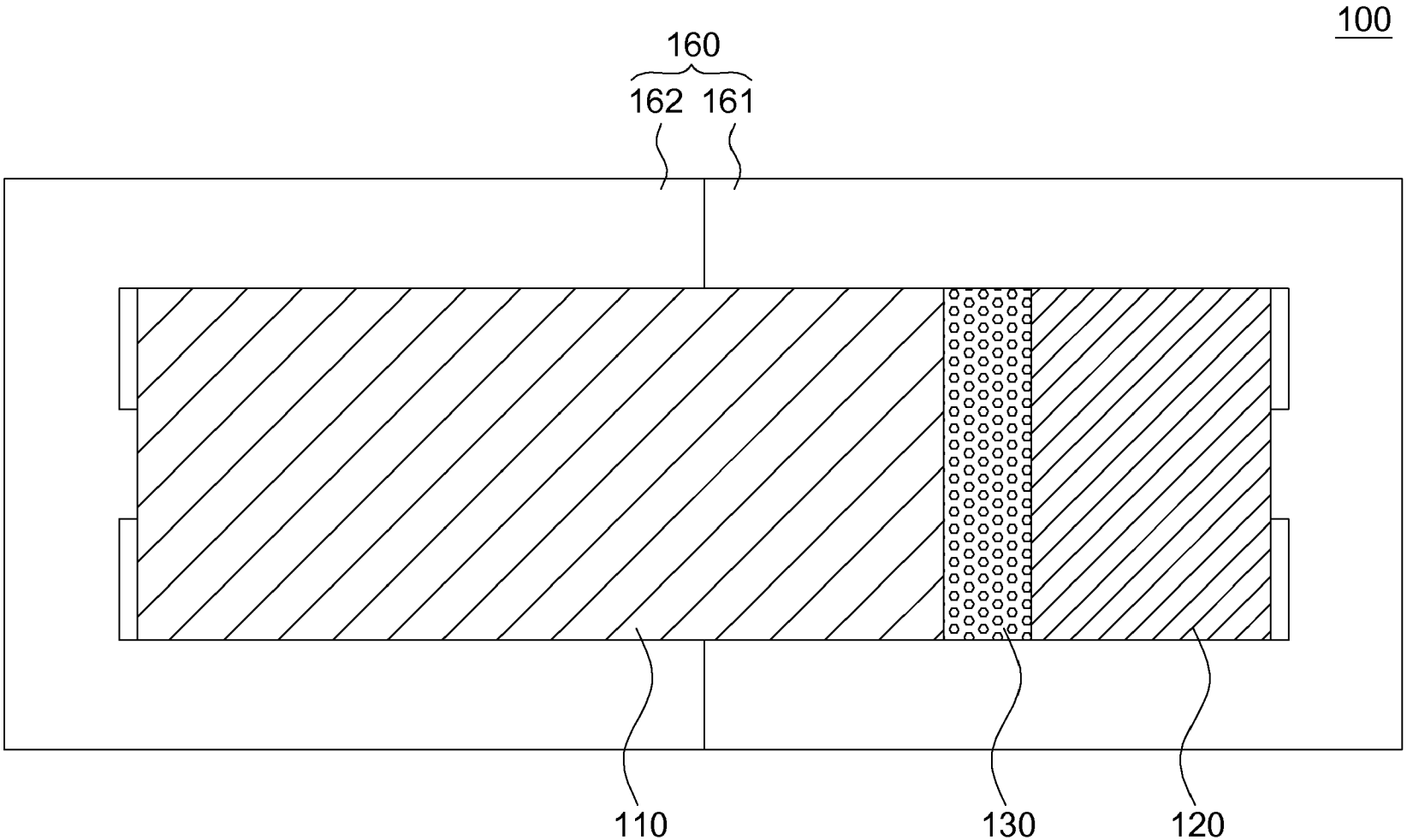
FIG. 1C shows the relative positions of a high voltage coil, a low voltage coil and a soft-magnetic colloid element according to the first embodiment of the present invention.

Please refer to FIGS. 1A~1C. FIG. 1A illustrates a front three-dimensional view of a transformer 100 according to a first embodiment of the present invention. FIG. 1B illustrate a back three-dimensional view of a lead frame 140 in FIG. 1A. FIG. 1C shows the relative positions of a high voltage coil 110, a low voltage coil 120 and a soft-magnetic colloid element 130. The transformer 100 includes at least a high voltage coil 110, at least a low voltage coil 120 and at least a soft-magnetic colloid element 130. The high voltage coil 110 and the low voltage coil 120 are showed in FIG. 1C. FIGS. 1A~1B only show a high voltage coil wiring area A110 and a low voltage coil wiring area A120. The high coil wiring area A110 is for wiring the high voltage coil 110, and the low voltage coil wiring area A120 is for wiring the low voltage coil 120. The transformer 100 of the present embodiment includes a high voltage coil 110, a low voltage coil 120 and a soft-magnetic colloid element 130 as an example. The soft-magnetic colloid element 130 is disposed between the high voltage coil 110 and the low voltage coil 120.

The soft-magnetic colloid element 130 includes a compound rubber 131 and several soft magnet powders 132. The soft magnet powders 132 are doped in the compound rubber 131. The compound rubber 131 is colloidal when not solidified. The compound rubber 131 is solid after solidified. Soft magnet powders 132 are doped in the un-solidified compound rubber 131. After the compound rubber 131 is solidified, the soft magnet powders 132 are embedded in the solidified compound rubber 131. Preferably, the soft magnet powders 132 are evenly distributed in the compound rubber 131.

The transformer 100 further includes a carrying frame 140, a containing tank 150 and an iron core 160. The high voltage coil 110, the low voltage coil 120 and the containing tank 150 surrounds the carrying frame 140. The containing tank 150 is disposed between the high voltage coil wiring area A110 and the low voltage coil wiring area A120. The containing tank 150 is for containing the soft-magnetic colloid element 130 so that the soft-magnetic colloid element 130 surrounds the carrying frame 140 and is positioned between the high voltage coil 110 and the low voltage coil 120.

The iron core structure 160 is an EI-type iron core structure and includes a first iron core 161 and a second iron core 162. The first iron core 161 includes three columns 161(1), 161(2) and 161(3). The second iron core 162 includes three columns 162(1), 162(2) and 162(3). The carrying frame 140 has a through hole 140*a*. The middle column 161(2) of the first iron core 161 and the middle column 162(2) of the second iron core 162 are inserted into two ends of the through hole 140*a*. The first iron core 161 and the second iron core 162 are combined together through the through hole 140*a*.

Figure 2:
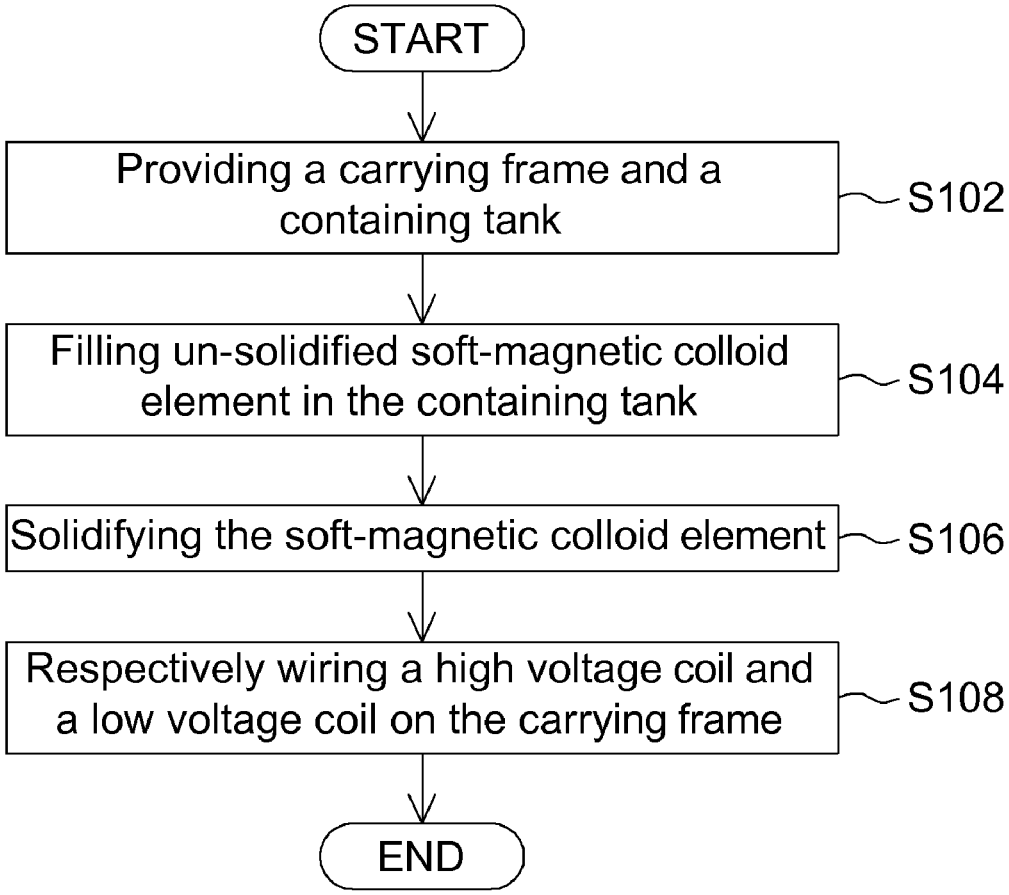
FIG. 2 is a flow chart of a method of manufacturing the transformer according to the first embodiment of the present invention.

Please further refer to FIG. 2. FIG. 2 is a flow chart of a method of manufacturing the transformer 100 according to the first embodiment of the present invention. First, in a step S102, the carrying frame 140 and the containing tank 150 are provided. The carrying frame 140 and the containing tank 150 are made of insulation materials. Preferably, the carrying frame 140 and the containing tank 150 are integrally formed structures through methods like injection molding.

Next, in a step S104, the un-solidified soft-magnetic colloid element 130 is filled in the containing tank 150. At this moment, the compound rubber 131 is not solidified. The soft magnet powders 132 are filled in the containing tank 150 along with the compound rubber 131.

The compound rubber 131 is for example made of UV light glue, silicone and epoxy. The soft magnet powders 132 are for example made of manganese-zinc alloy and nickel-zinc alloy. The percentage of soft magnet powders 132 in the soft-magnetic colloid element 130 is about 50% to 80%.

After the soft-magnetic colloid element 130 is filled in the containing tank 150, the soft-magnetic colloid element 130 surrounds the entire carrying frame 140. Preferably, the soft magnet powders 132 are distributed in the compound rubber 131 evenly so that the soft magnet powders 132 are distributed evenly around the carrying frame 140.

No matter what size the carrying frame 140 is, the soft-magnetic colloid element 130 is able to be filled in the containing tank 150 smoothly and surrounds the carrying frame 140. In other words, the soft-magnetic colloid element 130 is suitable for carrying frames 140 in all sizes.

Then, in a step S106, the soft-magnetic colloid element 130 is solidified. The method of solidifying the soft-magnetic colloid element 130 is decided according to the material of the compound rubber 131. For example, when the compound rubber 131 is made of UV light glue, the soft-magnetic colloid element 130 is solidified by UV light. When the compound rubber 131 is made of epoxy, the soft-magnetic colloid element 130 is solidified by thermal cure. Meanwhile, the soft-magnetic colloid element 130 is shaped according to the shape of the inner walls of the containing tank 150. Also, the soft-magnetic colloid element 130 surrounds and is fixed around the carrying frame 140. As a result, the soft-magnetic colloid element 130 is formed and shaped only by filling the soft-magnetic colloid element 130 into the containing tank 150 and following by a simple curing process. There is no need to perform complicated process such as casting and sintering.

Afterwards, in a step S108, the high voltage coil 110 and the low voltage coil 120 are wound on the carrying frame 140. The high voltage coil 110 and the low voltage coil 120 are respectively located on two sides of the soft-magnetic colloid element 130. Accordingly, the transformer 100 according to the first embodiment is formed.

As shown in FIG. 1C, the soft-magnetic colloid element 130 between the high voltage coil 110 and the low voltage coil 120 is able to increase a magnetic loop to increase the leakage inductance and inductance of the transformer 100. In other words, the leakage inductance and inductance are increased with neither enlarging the distance between the high voltage coil 110 and the low voltage coil 120, nor reducing the diameters of the high voltage coil 110 and the low voltage coil 120. As a result, the transformer 100 of the present embodiment has properties including small size, high leakage inductance and high inductance, which is very suitable for cold cathode fluorescent lamp. Furthermore, the efficiency of the cold cathode fluorescent lamp is significantly improved.

Moreover, through the above-described manufacturing method, the carrying frame 140 is 360 degree surrounded by the soft-magnetic colloid element 130. Because general soft-magnetic metal is stiff and shaped, it cannot be formed as a circular structure connected with the carrying frame 140. Even the soft-magnetic metal is a U-shaped or C-shaped structure surrounding the carrying frame 140, it cannot completely covering the carrying frame 140. The soft-magnetic colloid element 130 of the present embodiment is able to easily surround the carrying frame 140 in 360 degrees for forming a complete magnetic loop.

Second Embodiment

Figure 3A:
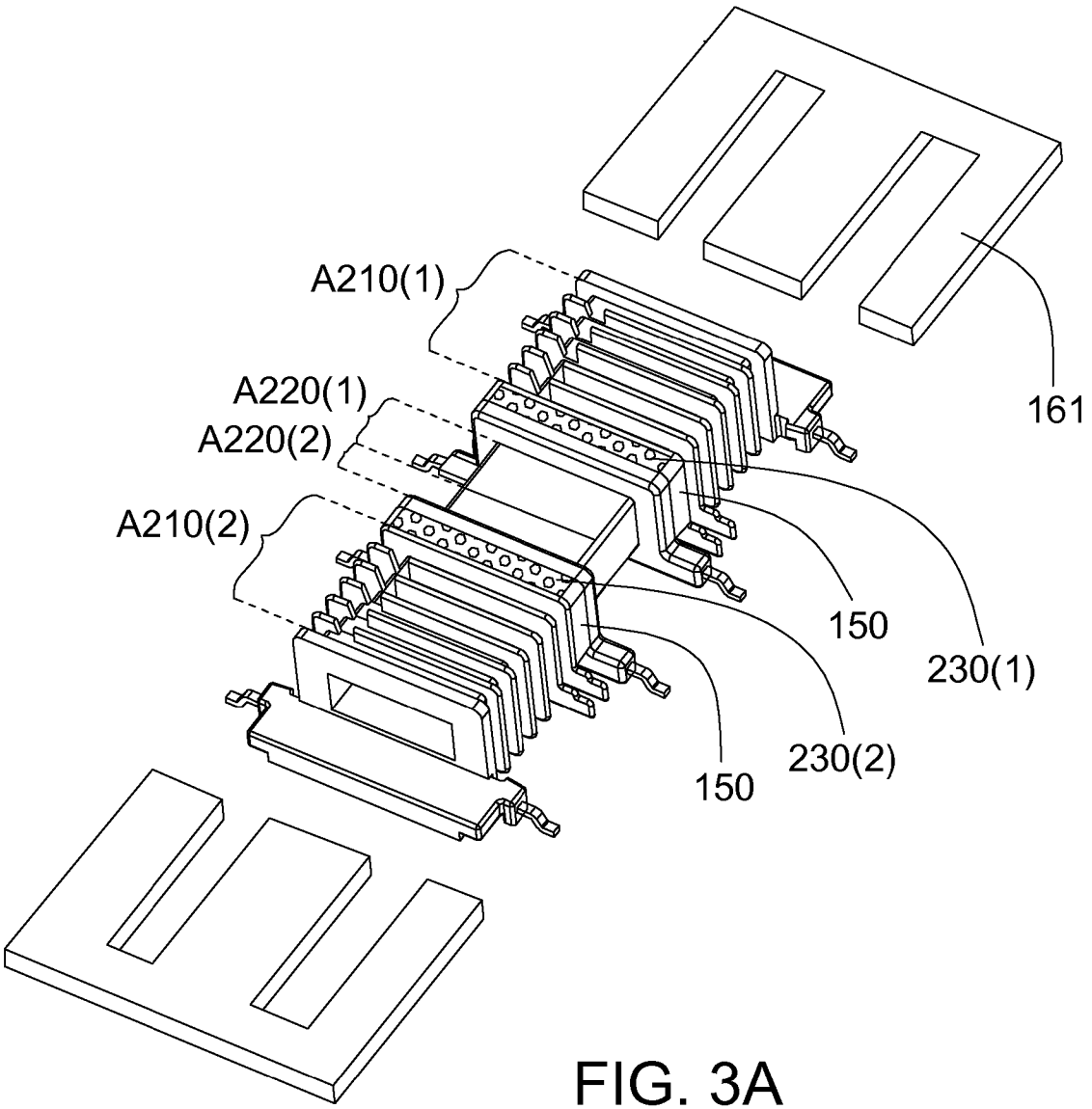
FIG. 3A is a front three-dimensional view of the transformer according to a second embodiment of the present invention.
Figure 3B:
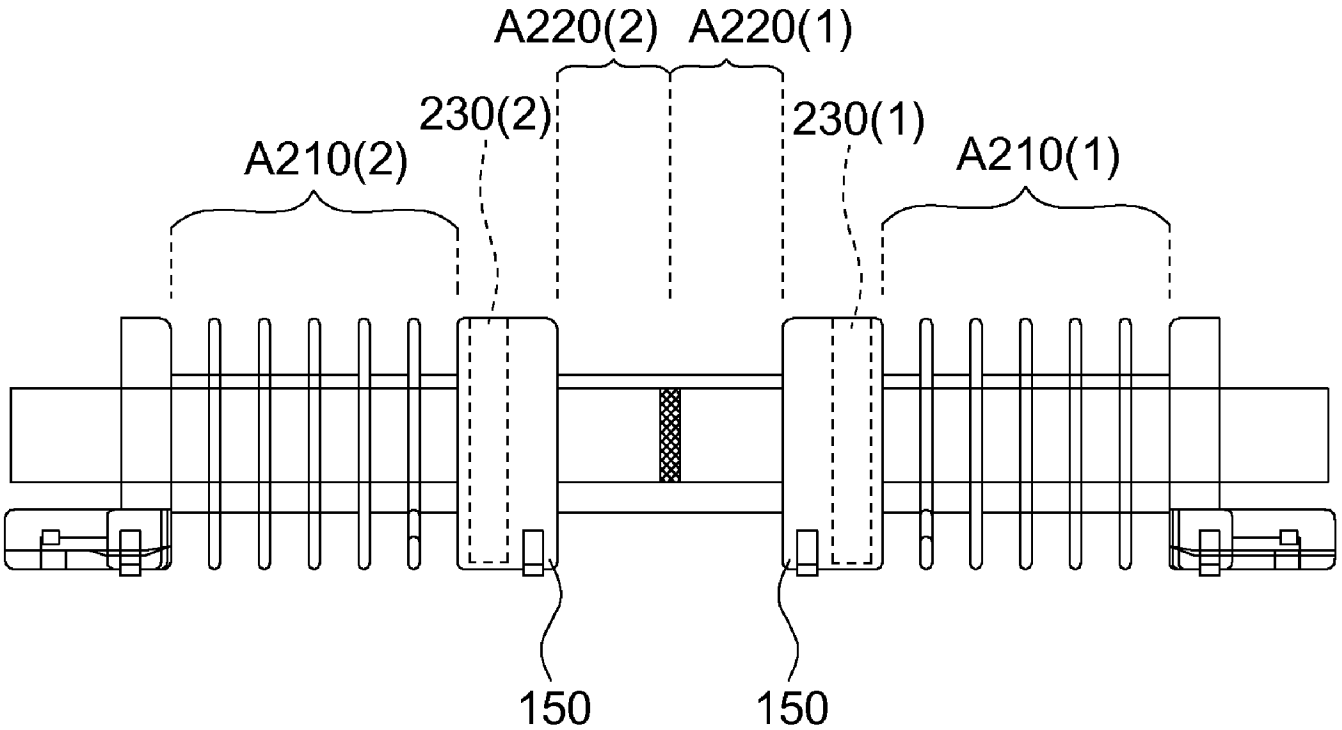
FIG. 3B illustrates a side view of the lead frame in FIG. 3A.
Figure 3C:
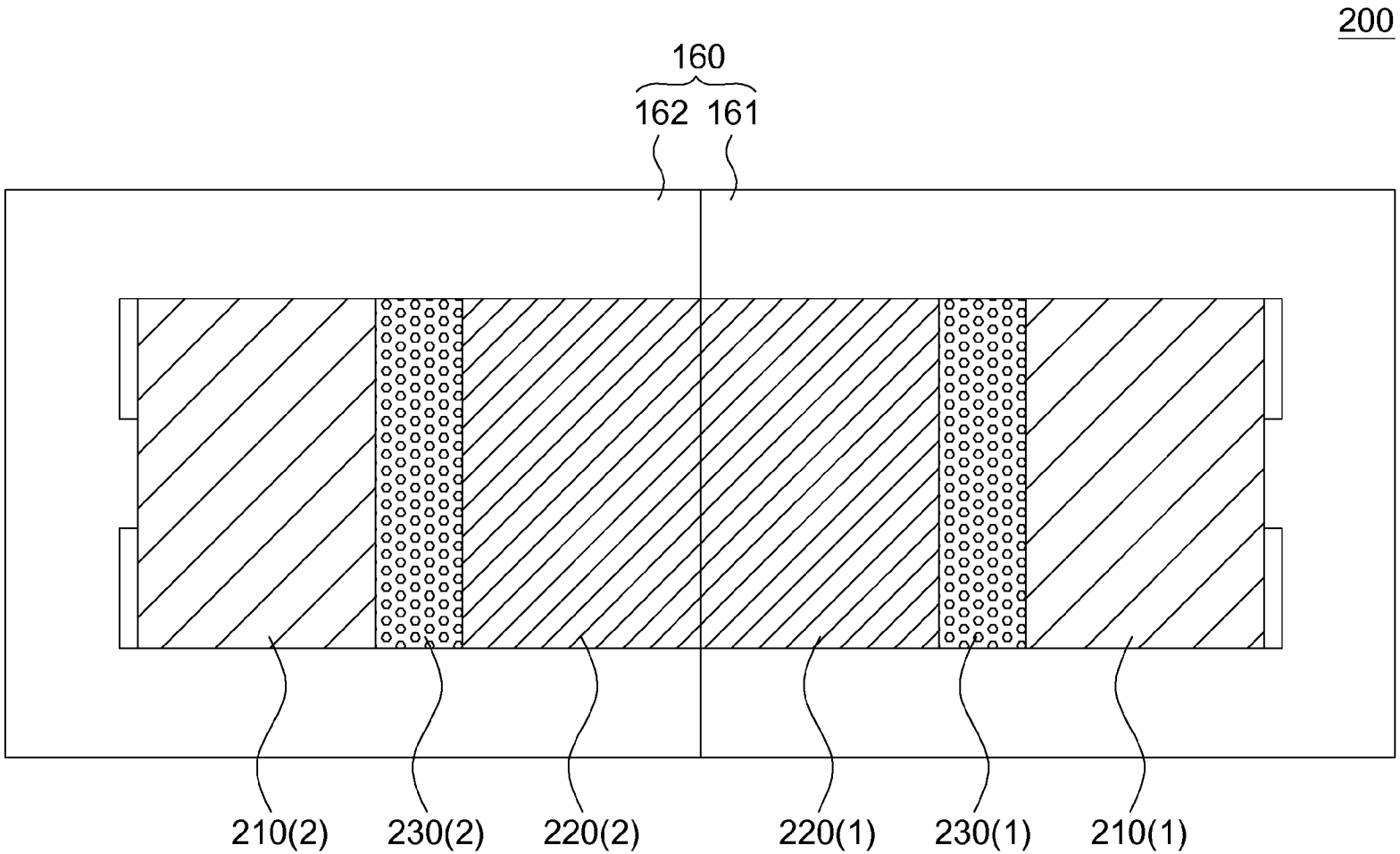
FIG. 3C shows the relative positions of the high voltage coils, the low voltage coils and the soft-magnetic colloid elements according to the second embodiment of the present invention.

Please refer to FIGS. 3A~3C. FIG. 3A is a front three-dimensional view of the transformer 200 according to a second embodiment of the present invention. FIG. 3B illustrates a side view of the lead frame 240 in FIG. 3A. FIG. 3C shows the relative positions of the high voltage coils 210(1) and 210(2), the low voltage coils 220(1) and 220(2) and the soft-magnetic colloid elements 230(1) and 230(2). The difference between the transformer 200 of the present embodiment and the transformer 100 of the first embodiment is the number and the positions of the high voltage coils 210(1) and 210(2), the low voltage coil 220(1) and 220(2) and the soft-magnetic colloid elements 230(1) and 230(2). The other parts are the same and not described repeatedly.

The transformer 200 of the present embodiment includes two high voltage coils 210(1) and 210(2), two low voltage coils 220(1) and 220(2) and two soft-magnetic colloid elements 230(1) and 230(2). The high voltage coils 210(1) and 210(2) are disposed respectively on two ends of the transformer 200. The two low voltage coils 220(1) and 220(2) are disposed between the high voltage coils 210(1) and 210(2). The high voltage coils 210(1) and 210(2) and the low voltage coils 220(1) and 220(2) are shown in FIG. 3C. FIGS. 3A~3B only show the high voltage coil wiring area A210(1) and A210(2) and the low voltage coil wiring area A220(1) and A220(2). The high voltage coil wiring area A210(1) and A210(2) are respectively for wiring the high voltage coils 210(1) and 210(2). The low voltage coil wiring area A220(1) and A220(2) are respectively for wiring low voltage coils 220(1) and 220(2). The soft-magnetic colloid element 230(1) is disposed between the high voltage coil 210(1) and the low voltage coil 220(1). The soft-magnetic colloid element 230(2) is disposed between the high voltage coil 210(2) and the low voltage coil 220(2). As shown in FIG. 3C, the high voltage coil 210(1), the soft-magnetic colloid element 230(1), the low voltage coil 220(1), the low voltage coil 220(2), the soft-magnetic colloid element 230(2) and the high voltage coil 210(2) are arranged orderly. Each of the soft-magnetic colloid elements 230(1) and 230(2) increases a magnetic loop, so that the transformer 200 has the properties including small size, high leakage inductance and high inductance.

Third Embodiment

Figure 4:
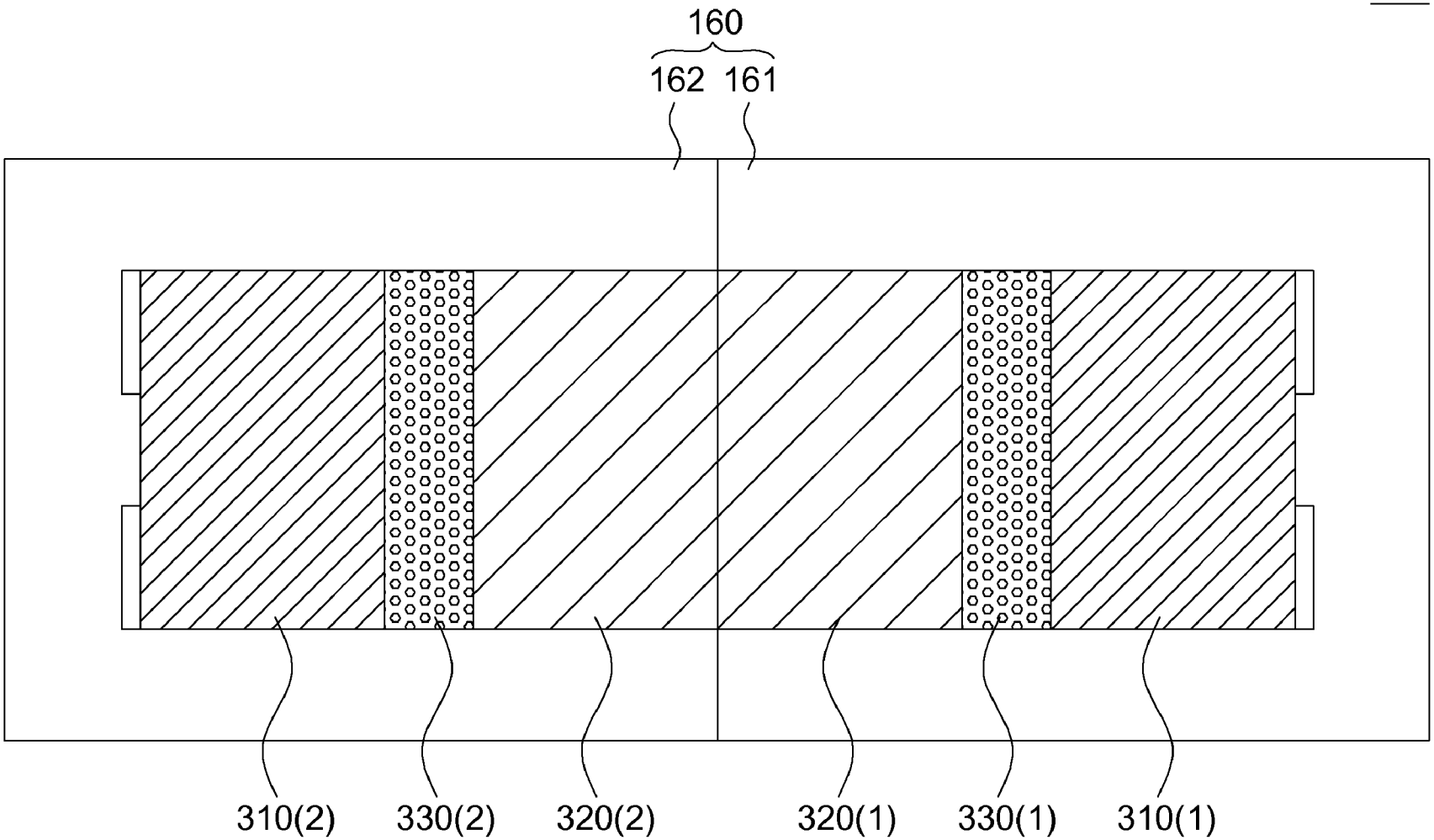
FIG. 4 shows the relative positions of the high voltage coils, the low voltage coils and the soft-magnetic colloid elements of the transformer according to a third embodiment of the present invention.

Please refer to FIG. 4. FIG. 4 shows the relative positions of the high voltage coils 310(1) and 310(2), the low voltage coils 320(1) and 320(2) and the soft-magnetic colloid elements 330(1) and 330(2) of the transformer 300 according to a third embodiment of the present invention. The difference between the transformer 300 of the present embodiment and the transformer 100 of the first embodiment is the number and positions of the high voltage coils 310(1) and 310(2), the low voltage coils 320(1) and 320(2) and the soft-magnetic colloid elements 330(1) and 330(2). Other parts are the same and not described repeatedly.

The transformer 300 of the present embodiment includes two high voltage coils 310(1) and 310(2), two low voltage coils 320(1) and 320(2) and two soft-magnetic colloid elements 330(1) and 330(2). The low voltage coils 320(1) and 320(2) are disposed respectively on two ends of the transformer 300. The high voltage coils 310(1) and 310(2) are disposed between the low voltage coils 320(1) and 320(2). The soft-magnetic colloid element 330(1) is disposed between the low voltage coil 320(1) and the high voltage coil 310(1). The soft-magnetic colloid element 330(2) is disposed between the low voltage coil 320(2) and the high voltage coil 310(2). As shown in FIG. 4, the low voltage coil 320(1), the soft-magnetic colloid element 330(1), the high voltage coil 310(1), the high voltage coil 310(2), the soft-magnetic colloid element 330(2) and the low voltage coil 320(2) are arranged orderly. Each of the soft-magnetic colloid elements 330(1) and 330(2) increases a magnetic loop, so that the transformer 300 has the properties including small size, high leakage inductance and high inductance.

The transformers disclosed in the above embodiments use soft-magnetic colloid element to replace soft-magnetic metal, so that the transformers have many advantages. Only some of the advantages are described as follows.

First, the soft-magnetic colloid element disposed between the high voltage coil and the low voltage coil increases a magnetic loop, which increases the leakage inductance and the inductance of the transformer. In other words, the leakage inductance and the inductance are increased with neither enlarging the distance between the high voltage coil and the low voltage coil nor reducing the diameters of the high voltage coil and the low voltage coil.

Second, the transformer with soft-magnetic colloid element has the properties including small size, high leakage inductance and high inductance, which is very suitable for cold cathode fluorescent lamp. Furthermore, the efficiency of the cold cathode fluorescent lamp is significantly improved.

Third, the carrying frame and the containing tank are made of insulation materials. Preferably, the carrying frame and the containing tank are integrally formed structures through methods like injection molding, which does not increase the manufacturing processes and material cost.

Fourth, the soft-magnetic colloid element is formed and shaped only by filling the soft-magnetic colloid element into the containing tank and following by a simple curing process. There is no need to perform complicated process such as casting and sintering.

Fifth, no matter what size the carrying frame is, the soft-magnetic colloid element is able to be filled in the containing tank smoothly and surrounds the carrying frame. In other words, the soft-magnetic colloid element is suitable for carrying frames in all sizes.

Sixth, the soft-magnetic colloid element is able to easily surround the carrying frame in 360 degrees for forming a complete magnetic loop.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A transformer comprising:

at least a high voltage coil;

at least a low voltage coil;

at least a soft-magnetic colloid element disposed between the high voltage coil and the low voltage coil;

a containing tank disposed between the high voltage coil and the low voltage coil for containing the soft-magnetic colloid element; and a carrying frame, the high voltage coil, the low voltage coil and the soft-magnetic colloid element surrounding the carrying frame;

wherein the containing tank includes an outer wall and an opening, and the outer wall surrounds the carrying frame to form a containing space between the outer wall and the carrying frame;

wherein the soft-magnetic colloid element is contained within the containing tank through the opening.

2. The transformer according to claim 1, wherein the soft-magnetic colloid element is adjacent to the low voltage coil.

3. The transformer according to claim 1 comprising two high voltage coils, two low voltage coils and two soft-magnetic colloid elements, the voltage coils respectively disposed on two ends of the transformer, the low voltage coils disposed between the high voltage coils, the soft-magnetic colloid elements respectively disposed between one high voltage coil and one low voltage coil.

4. The transformer according to claim 1 comprising two high voltage coils, two low voltage coils and two soft-magnetic colloid elements, the low voltage coils respectively disposed on two ends of the transformer, the high voltage coil disposed between the low voltage coils, the soft-magnetic colloid element respectively disposed between one high voltage coil and one low voltage coil.

5. The transformer according to claim 1, wherein the soft-magnetic colloid element comprises:

a compound rubber; and a plurality of soft magnet powders doped in the compound rubber.

6. The transformer according to claim 5, wherein the soft magnet powders are distributed evenly in the compound rubber.

7. The transformer according to claim 5, wherein the material of the compound rubber comprises UV light glue, silicone and epoxy.

8. The transformer according to claim 5, wherein the material of the soft magnet powders comprises manganese-zinc alloy and nickel-zinc alloy.

9. The transformer according to claim 5, wherein the percentage of soft magnet powers in the soft-magnetic colloid element is about 50% to 80%.

10. The transformer according to claim 1, wherein the carrying frame and the containing tank are integrally-formed structures, and the containing tank surrounds the carrying frame.

11. The transformer according to claim 10, wherein the soft-magnetic colloid element is filled in the containing tank and surrounds the carrying frame.

12. The transformer according to claim 1, wherein the soft-magnetic colloid element is exposed through the opening of the containing tank.

* * * * *